United States Patent [19]

Sato

[11] Patent Number: 4,913,745

[45] Date of Patent: Apr. 3, 1990

[54] METHOD FOR PRODUCING A RARE EARTH METAL-IRON-BORON ANISOTROPIC BONDED MAGNET FROM RAPIDLY-QUENCHED RARE EARTH METAL-IRON-BORON ALLOY RIBBON-LIKE FLAKES

[75] Inventor: Tadakuni Sato, Miyagi, Japan

[73] Assignee: Tokin Corporation, Miyagi, Japan

[21] Appl. No.: 171,694

[22] Filed: Mar. 22, 1988

[30] Foreign Application Priority Data

| | | | |
|---|---|---|---|
| Mar. 23, 1987 | [JP] | Japan | 62-68705 |
| Apr. 15, 1987 | [JP] | Japan | 62-92492 |
| Sep. 5, 1987 | [JP] | Japan | 62-221219 |
| Sep. 7, 1987 | [JP] | Japan | 62-222109 |
| Oct. 15, 1987 | [JP] | Japan | 62-258190 |
| Oct. 15, 1987 | [JP] | Japan | 62-258191 |
| Oct. 16, 1987 | [JP] | Japan | 62-259791 |

[51] Int. Cl.[4] ..... H01F 1/02

[52] U.S. Cl. ..... 148/103; 148/104; 148/108; 164/463

[58] Field of Search ..... 148/103, 104, 108; 164/76.1, 463, 477

[56] References Cited

U.S. PATENT DOCUMENTS

| | | | |
|---|---|---|---|
| 4,558,077 | 12/1985 | Gray | 148/103 |
| 4,743,311 | 5/1988 | Schultz et al. | 148/104 |
| 4,810,309 | 3/1989 | Coehoorn et al. | 164/463 |

FOREIGN PATENT DOCUMENTS

| | | | |
|---|---|---|---|
| 61552 | 4/1984 | Japan | 164/477 |
| 184603 | 9/1985 | Japan | 148/101 |

OTHER PUBLICATIONS

Herbst, J. F. et al., "Relationships Between Crystal Structure and Magnetic Properties in $Nd_2Fe_{14}B$," *Physical Review B*, 29, 4176, 1984.

*Primary Examiner*—L. Dewayne Rutledge
*Assistant Examiner*—George Wyszomierski
*Attorney, Agent, or Firm*—Hopgood, Calimafde, Kalil, Blaustein & Judlowe

[57] ABSTRACT

A method is disclosed for producing a rare earth metal-transition metal-boron (R-T-B) bonded magnet with a magnetic anisotropy. R-T-B alloy ribbons and/or ribbon-like flakes containing $R_2T_{14}B$ fine crystals are prepared with a thickness of 20–1,000 μm by rapidly-quenching method. The ribbons and/or flakes are crushed and ground into a magnetic powder of particle sizes smaller than the value of the ribbon thickness. The magnetic powder is mixed with binder agent and formed into desired bulk-shape body in an aligning magnetic field to produce the bonded magnet with the magnetic anisotropy. In order to improve the magnetic properties, the ribbons and/or flakes can be heat-treated at a temperature of 650°–950° C. The magnetic powder can also be teat-treated at a temperature of 500°–700° C.

23 Claims, 7 Drawing Sheets

METHOD FOR PRODUCING A RARE EARTH METAL-IRON-BORON ANISOTROPIC BONDED MAGNET FROM RAPIDLY-QUENCHED RARE EARTH METAL-IRON-BORON ALLOY RIBBON-LIKE FLAKES

BACKGROUND OF THE INVENTION (1) Field of the Invention

This invention relates to rare earth metal-transition metal-boron (R-T-B) permanent magnets and, in particular, to a method for producing such permanent magnets with anisotropy of a bonded type wherein rapidly-quenched R-T-B alloy powder is bonded by binder.

(2) Description of the Prior Art

As an R-T-B permanent magnet alloy, N. C. Koon and B. N. Das disclosed magnetic properties of amorphous and crystallized alloy of $(Fe_{0.82}B_{0.18})_{0.9}Tb_{0.05}La_{0.05}$ in Appl. Phys. Lett. 39(10) (1981), 840 (Reference 1.) They wrote that crystallization of the alloy occurred near the relatively high temperature of 900 K, which also marked the onset of dramatic increase in the intrinsic coercive force. They found out that the alloy in the crystallized state appeared potentially useful as low cobalt permanent magnets.

J. J. Croat proposed amorphous R-Fe-B (Nd and/or Pr is especially used for R) alloy having magnetic properties for permanent magnets as disclosed in JP-A-59064739 (Reference 2, which corresponds to U.S. patent applications Ser. Nos. 414,936 (now U.S. Pat. No. 4,851,058), and 508,266) and JP-A-60009852 (Reference 3, which corresponds to U.S. patent applications Ser. Nos. 508,266 and 544728 (now U.S. Pat. No. 4,802,931). References 2 and 3 disclose that other transition metal elements can be used in place of or in part of Fe. Those magnetic properties were considered to be caused by a microstructure where Nd2Fe14B magnetic crystal grains having a grain size of 20–400 nm were dispersed within an amorphous Fe phase. Reference is further made to R. K. Mishra: J. magnetism and Magnetic Materials 54–57 (1986) 450 (Reference 4).

The rapidly-quenched alloy ribbon is prepared by the continuous splat-quenching method which is disclosed in, for example, a paper entitled "Low-Field Magnetic Properties of Amorphous Alloys" written by Egami, Journal of The American Ceramic Society, Vol. 60, No. 3–4, March–April 1977, p.p. 128–133 (Reference 5.) A similar continuous splat-quenching method is disclosed as a "Melt Spinning" method in References 2 and 3. That is, R-T-B molten alloy is ejected through a small orifice onto an outer peripheral chill surface of a copper disk rotating at a high speed. The molten alloy is rapidly quenched by the disk to form a rapidly-quenched ribbon. Then, a comparatively high cooling rate produces an amorphous alloy but a comparatively low cooling rate crystallises the metal.

According to References 2 and 3, the principal limiting factor for the rate of chill of a ribbon of alloy on the relatively cooler disk surface is its thickness. If the ribbon is too thick, the metal most remote from the chill surface will cool too slowly and crystallise in a magnetically soft state. If the alloy cools very quickly, the ribbon will have a microstructure that is somewhere between almost completely amorphous and very, very finely crystalline. That is, the slower cooling surface of the ribbon farthest from the chill surface is more crystallised but the other quickly cooling surface impinging the chill surface is hardly crystallised, so that crystallite size varies throughout the ribbon thickness.

References 2 and 3 describe that those magnetic materials exhibiting substantially uniform crystallite size across the thickness of the ribbon tend to exhibit better permanent magnetic properties than those showing substantial variation in crystallite size throughout the ribbon thickness.

In order to produce a practical magnet, the rapidly-quenched alloy ribbon is crushed and formed into a bonded magnet. Reference is made to a paper entitled "PROCESSING OF NEODYMIUM-IRON-BORON MELT-SPUN RIBBONS TO FULLY DENSE MAGNETS" presented by R. W. Lee et al at the International Magnetics Conference, held at St. Paul, Minn., on Apr. 29, 1985, and published in IEEE Transactions on Magnetics, Vol. MAG-21, No. 5, September 1985, Page 1958 (Reference 6.)

Generally speaking, the Nd-Fe-B rapidly-quenched alloy can provide only an isotropic magnet because of its crystallographically isotropy. This means that a high performance anisotropic permanent magnet of a bonded type cannot be obtained from the rapidly-quenched alloy. Reference 6 discloses that the bonded magnet has energy product of 9 MGOe or less.

Reference 6 further discloses that magnetic alignment was strongly enhanced by upsetting fully dense hot-pressed samples of the crushed alloy ribbons.

JP-A-60089546 (Reference 7) discloses a rapidly quenched R-Fe-B permanent magnet alloy with a high coercive force. The alloy contains very fine composite structures less than 5 $\mu$m predominant of tetragonal crystal compositions and is crushed into powders having particle sizes of $-100$ Tyler mesh (less than 300 $\mu$m) for use in production of a bonded magnet. However, no magnetic properties of the bonded magnets are disclosed therein. Although Reference 7 discloses that C-axis anisotropy was appreciated by application of X-ray diffraction microscopy to a surface of the alloy. However, the crushed powder cannot actually be magnetically aligned.

Sagawa et al proposed an anisotropic R-Fe-B sintered magnet in JP-A-59046008 (Reference 8) which was produced from an ingot of an alloy of R (especially Nd,) Fe, and B by a conventional powder metallurgical processes.

However, the R-Fe-B alloy tends to be oxidized in production of the magnet, because the R-Fe-B alloy ingot comprises the magnetic crystalline phase of the chemical compound $R_2Fe_{14}B$ and the R-rich solid solution phase and because the solid solution phase is very active to oxygen. Accordingly, it is difficult to produce an anti-corrosion anisotropic sintered magnet.

On the other hand, bonded magnets comprises magnetic particles dispersed in and covered with the binder so that the anti-corrosion magnets can be obtained readily. Further, the bonded magnets are simple in a production method in comparison with the sintered magnets and the hot-pressed magnets disclosed in Reference 6.

SUMMARY OF THE INVENTION

Therefore, it is an object of the present invention to provide a method for producing a bonded-type rare earth metal-iron-boron magnet with an anisotropy and therefore, with improved magnetic properties.

A rare earth-transition metal-boron (R-T-B) magnet of a bonded type comprises a magnetic powder of R-T-B alloy substantially consisting of $R_2T_{14}B$ which is dispersed in and bonded by binder agent. A method for producing the bonded-type magnet according to the present invention comprises steps of: preparing the R-T-B alloy in a molten state; rapidly quenching the molten alloy to form R-T-B alloy ribbon and/or ribbon-like flakes, each having a thickness of 20–1,000 μm and having $R_2T_{14}B$ crystal grains; crushing and grinding the ribbon and/or flakes into a magnetic powder; mixing the magnetic powder with an binder agent to form a mixture; forming the mixture into a desired bulk-shape body within an aligning magnetic flux to produce a bonded magnet with an magnetic anisotropy.

The magnetic powder is formed to have an average particle size of a value less than the thicknes.

According to another aspect of the present invention, the method can further comprise a step of heat-treating the magnetic powder at a temperature of 500°–700° C. prior to the mixing step.

According to still another aspect of the present invention, the method can also comprise a step of heat-treating the alloy ribbon and/or flakes at a temperature of 650°–950° C. prior to the crushing and grinding step.

The forming step may comprise a process for pressing the mixture into the desired bulk-shape body in the aligning magnetic field by a pressing force. In this case, the binder agent is a thermosetting resin having a curing temperature. The bulk-shape body is heated at the curing temperature to produce the bonded magnet.

The forming step alternatively may comprise a process for heating and injecting the mixture into a mould at a resin melting temperature in the aligning magnetic field to produce the bonded magnet. In this case, the binder agent is a thermoplastic resin having the resin melting temperature.

In the rapidly-quenching step, a process can be used wherein the molten alloy is ejected through a small orifice onto an outer peripheral chill surface of a quenching disk rotating at a predetermined speed. The ejected molten alloy is thereby rapidly cooled into the rapidly-quenched ribbon and/or ribbon-like flakes.

In the process, another quenching disk can be used so that, after the molten alloy is deposited onto the chilling surface and is rapidly quenched to form a ribbon, an outer surface of the ribbon is rapidly quenched by engagement with the other quenching disk to obtain a rapidly-quenched ribbon.

A magnetic field may be applied in a radial direction of the quenching disk so that the ejected molten alloy is cooled in the magnetic field.

Further, the quenching disk can be provided with a plurality of projections formed in the chilling surface and a cooling plate is disposed adjacent the quenching disk. The molten alloy ejected onto the chilling surface is sprayed onto the cooling plate to form flat ribbon-like flakes.

In the rapidly-quenching step, another process can be used wherein the molten alloy is sprayed and atomized through a spray nozzle onto a cooling plate and rapidly cooled on the cooling plate to form flat ribbon-like flakes.

DESCRIPTION OF THE INVENTION

Figure 1:
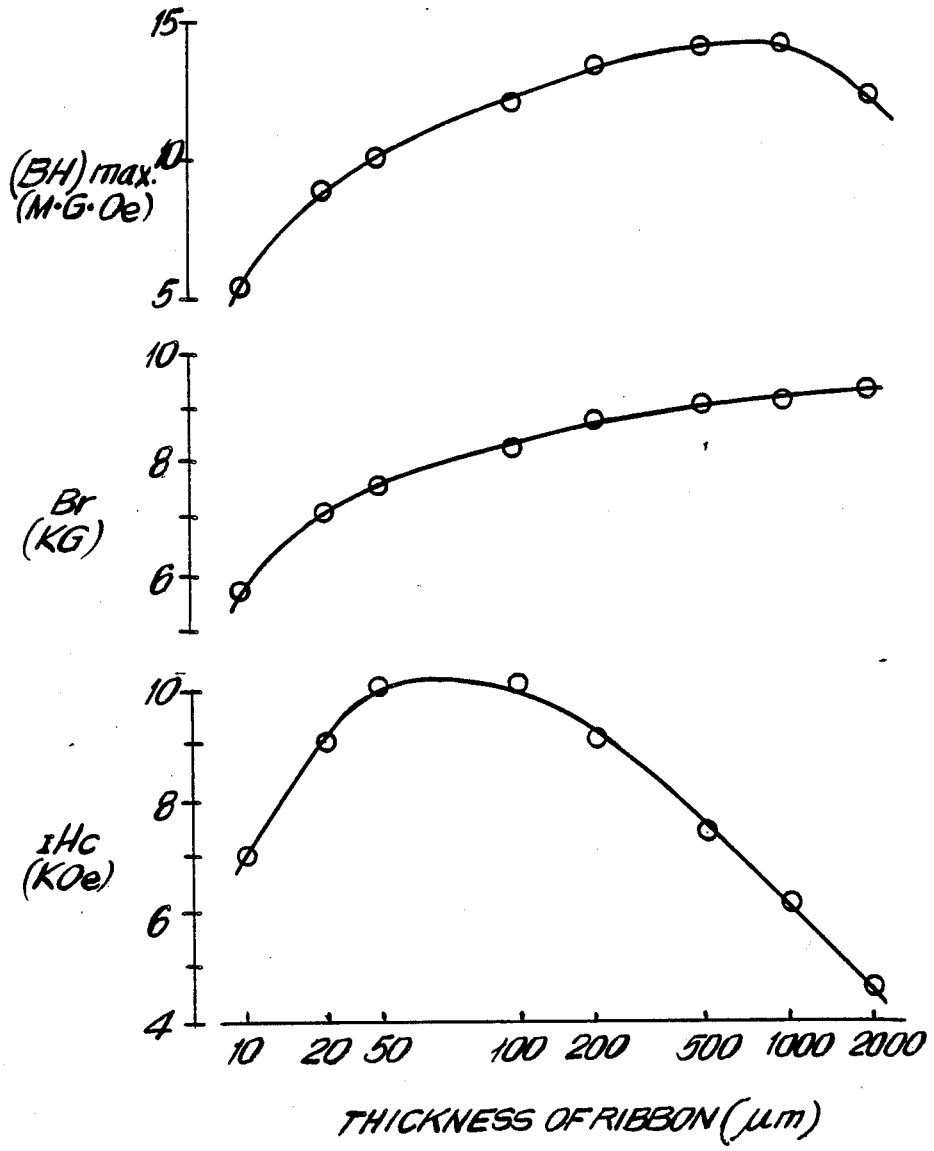
FIG. 1 is a graph showing magnetic properties of bonded magnets in Example 1 together with thickness of used alloy ribbons.

The present invention was made on the novel facts as disclosed in copending patent application Ser. No. 138,250 by joint inventors including the present inventor filed on Nov. 25, 1987 which was assigned to the same assignee, and is now U.S. Pat. No. 4,881,986. That is, the magnetic crystal of $R_2T_{14}B$ had a predominant grain growing direction in the C-plane of the crystal. Further, the C-plane of the crystal in the rapidly-quenched R-T-B alloy ribbon tends to orient in a direction parallel to the main surface of the ribbon when the crystal is grown in a grain size 5 μm or less. When the crystal grain grows larger than 5 μm, the crystal grows in a needle-like form and the C-plane of the crystal has an orientation in a direction perpendicular to the main surface of the ribbon.

Those facts mean that the rapidly-quenched alloy ribbon has a high anisotropy when crystals are uniformly grown to have a generally equal and comparatively large grain size. Then, it will be noted that a powder obtained by grinding the rapidly-quenched anisotropic alloy ribbon can be magnetically aligned in a magnetic field. Therefore, it will be appreciated that a bonded magnet with anisotropy can be produced by mixing the powder with binder agent and compacting into a desired shape within an aligning magnetic field.

In the continuous splat-quenching method, sizes of grains vary across the thickness of the ribbon because the cooling speed is different between the chill surface and the free surface of the ribbon. Accordingly, the orientation of grains also vary in the direction of the thickness.

However, the orientations of adjacent crystal grains in the ribbon are generally equal as disclosed in the copending patent application, even if orientations are different between crystal grains distant from one another in the direction of thickness of the ribbon.

Briefly stating, the present invention attempts to use, as magnetic powder for a bonded magnet, a powder of $R_2T_{14}B$ alloy ribbon prepared by the rapidly-quenching method with a thickness of 20–1,000 μm. The powder has an average particle size smaller than the value of the thickness of the rapidly quenched alloy ribbon, for example, 5 μm or more which is usual in the conventional bonded-type magnet. The powder has magnetic anisotropy and can be aligned in a mixture with the binder agent by application of an aligning magnetic field.

Preferably, $R_2T_{14}B$ crystal grains of the alloy ribbons and/or flakes has an average grain size of 0.01–20 μm. The transition metal T should include Fe, and preferably consists by atomic ratio of Co 45 at % or less and the balance of Fe. A typical one of the rare earth metal R is Nd.

A preferable one for the thermosetting binder agent is epoxy resin, while a preferable one for the thermoplastic binder agent is polyethylene.

Now, description will be made as to examples of the present invention.

EXAMPLE 1

An ingot of an alloy consisting of R 32.0 wt %, B 1.1 wt %, and substantially balance of Fe was prepared by the induction melting in argon gas atmosphere. Starting materials used for R, B, and Fe were Nd of a purity factor of 97% including other rare earth metal elements mainly Ce and Pr, ferroboron containing B 20 wt %, and electrolytic iron, respectively.

The ingot was again melted by the induction melting in argon gas. The molten alloy was ejected through a small orifice on an outer chill surface of an iron disk rotating at various chill surface moving speeds of 1 m/sec through about 50 m/sec to produce rapidly-quenched alloy ribbons having various widths of 1 through 15 mm and various thicknesses of 10 μm, 20 μm, 50 μm, 100 μm, 200 μm, 500 μm, 1000 μm, and 2000 μm, respectively.

Those ribbons were observed by the X-ray diffraction microanalysis and found out to have fine $R_2Fe_{14}B$ crystal grains dispersed in the ribbons. Those crystal grains-mainly have grain sizes of about 3 μm or less in each ribbon having a thickness of 200 μm or less, about 10 μm or less in each ribbon having a thickness of 500 μm, and about 30 μm or less in each ribbon having a thickness of 2000 μm.

Generally speaking, the ribbon having an increased thickness has crystal grains having an increased grain size.

Further, it was observed by the X-ray diffraction microanalysis that the C-plane of the crystal in the rapidly-quenched R-Fe-B alloy ribbon tended to orient in a direction parallel to the main surface of the ribbon when the crystal grew to have a grain size 5 μm or less. When the crystal grain grows larger than 5 μm, the crystal is in a needle-like form and the C-plane of the crystal has an orientation in a direction perpendicular to the main surface of the ribbon.

Then, those ribbons having different thicknesses were individually crushed and ground by means of a ball mill to produce powders, respectively, each having an average particle size of 15 μm. Each powder was mixed with epoxy resin as binder material to form a mixture. An amount of the epoxy resin was 25% of a volume of the mixture. The mixture was compacted by a pressing force of 5 ton.f/cm$^2$ in an aligning magnetic field of 30 kOe to produce a compact body. The compact body was treated at a temperature of 110° C. for one hour so as to cure the epoxy resin to thereby form a bonded magnet. Then, magnetic properties of the bonded magnet were measured after being magnetized by application of a magnetic field of 30 kOe. The measured magnetic properties are shown in FIG. 1.

FIG. 1 shows that use of ribbon having a thickness of 20 μm or more provides an energy product $(BH)_{max}$ higher than 9 MGOe and a high residual magnetic flux density Br. Although a coercive force $_IH_C$ also increases as increase of the ribbon thickness to 100 μm, it decreases when the ribbon thickness increases over 100 μm and is excessively small when the ribbon thickness is 2000 μm. Accordingly, it is preferred that the ribbon has a thickness of 20–1000 μm.

EXAMPLE 2

Powders were prepared from ribbons having thicknesses of 20 μm, 100 μm, and 1000 μm, respectively, which were prepared in the similar manner as in Example 1. Those powders were heat-treated at 450°–750° C. for one hour in argon atmosphere. Thereafter, a bonded magnet was formed as a compact body from each of the powders and magnetic properties of the bonded magnet were measured in the similar manner as in Example 1. The measured magnetic properties are shown in FIG. 2.

Figure 2:
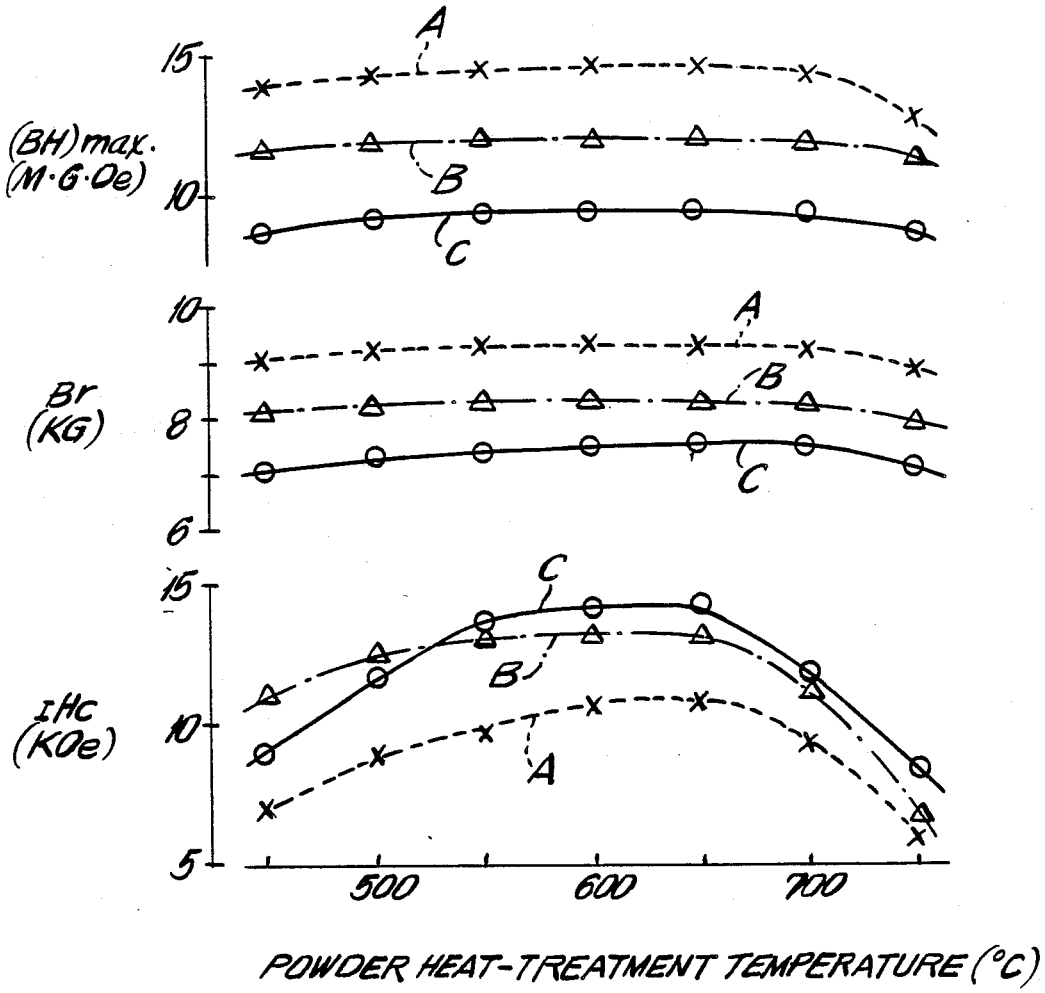
FIG. 2 is a graph showing magnetic properties of bonded magnets in Example 2 relative to heat-treatment temperatures of powders together with thickness of alloy ribbons.

In FIG. 2, broken lines A represent magnetic properties of magnets using alloy ribbons of 1000 μm thickness, alternate long and short dash lines B are for use of 100 μm thickness ribbons, and solid lines C are for 20 μm thickness ribbons.

It is noted from FIG. 2 that $_IH_C$ is improved by the heat treatment of the powder at a temperature of 500°–700° C. while $(BH)_{max}$ and Br are generally maintained unchanged even by the heat treatment.

EXAMPLE 3

An alloy ingot consisting of R 35.0 wt %, B 1.0 wt %, Co 7 wt %, and the balance of Fe was made in the similar manner as in Example 1. A start material of R consisted of cerium didymium consisting of Ce 5 wt %, Pr 15 wt %, and the substantially balance of Nd and an addition of 5 at % Dy. Ferroboron and electrolytic iron were also used for start materials of B and Fe.

The ingot was again melted and ejected onto a quenching disk rotating at a chill surface speed of 50 m/sec to produce a rapidly-quenched alloy ribbon with a width of about 2 mm and a thickness of 15 μm. Similarly, another rapidly-quenched alloy ribbon was produced with a width of about 10 mm and a thickness of 200 μm, using a chill surface speed of 5 m/sec. It was observed by the X-ray diffraction that the 15 μm thick ribbon had $R_2T_{14}B$ (T=Co+Fe) crystal grains mainly having a submicron-order grain size with C-plane of the crystal orienting in parallel with the main surface of the ribbon. While, the 200 μm thick ribbon had crystal grains of mainly 5 μm or less grain size and C-plane of the crystal also oriented in parallel with the main surface of the ribbon.

Those 15 μm thick and 200 μm thick ribbons were crushed and ground into powders, respectively, each powder having an average particle size of 10 μm in the similar manner as in Example 1. Each powder was heat-treated at 650° C. for one hour in argon atmosphere. Then, each powder was mixed with polyethylene as binder material of 40 vol % on the basis of volumetric percent of a resultant mixture. The mixture was heated at 100° C. to melt the polyethylene and injected into a mould at about 100° C. within an aligning magnetic field of 20 kOe to from a bonded magnet having a desired shape.

Magnetic properties of the resultant bonded magnets are shown in Table 1. It will be noted from Table 1 that use of the 200 μm thick ribbon provides excellent magnetic properties in comparison with the 15 μm thick ribbon.

TABLE 1

| Ribbon Thickness (μm) | Br (kG) | $_iH_C$ (kOe) | $(BH)_{max}$ (MGOe) |
|---|---|---|---|
| 15 | 5.6 | 12.5 | 6.0 |
| 200 | 7.3 | 11.0 | 11.5 |

EXAMPLE 4

Using a quenching copper disk rotating at a chill surface speed of about 10 m/sec, rapidly-quenched ribbons were prepared with a width of about 5 mm and a thickness of about 50 μm from the ingot prepared in Example 1.

It was observed by the X-ray diffraction microanalysis that the prepared ribbon had crystal grains mainly having grain sizes of 1 μm or less. The crystal grains generally have a C-plane orientation directed in a direction parallel with the main surface of the ribbon. The C-plane orientation is predominant in a free surface layer in comparison with a chill surface layer of the ribbon.

Then, the ribbons were heat-treated in argon atmosphere for two hours at 600° C., 700° C., 800° C., 900° C., and 1000° C., respectively, thereafter individually crushed and ground by use of a ball mill into powders each having an average particle size of 15 μm.

Then, each powder was mixed with epoxy resin of 25 vol % on the basis of volumetric percent of a resultant mixture which was, in turn, compacted into a compact body by a pressing force of 5 ton.f/cm$^2$ in an aligning magnetic field of 30 kOe. Then, the compacted body was heat-treated at 110° C. for one hour to form a bonded magnet.

Magnetic properties of resultant bonded magnets were measured after being exposed in a magnetic field of 30 kOe. The measured magnetic properties are shown in FIG. 3.

Figure 3:
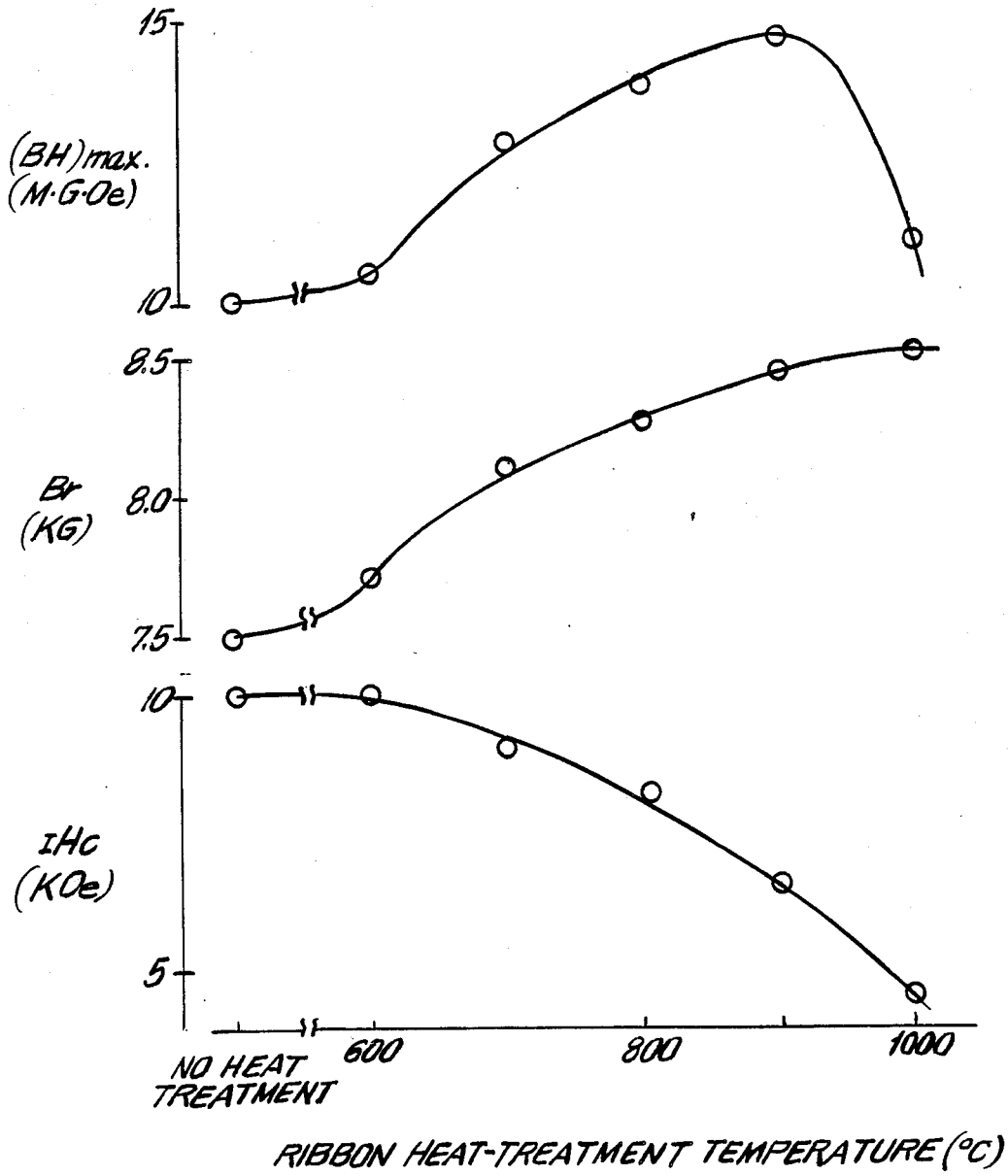
FIG. 3 is a graph showing magnetic properties of bonded magnets in Example 4 relative to heat-treatment temperatures of alloy ribbons.

It is noted from FIG. 3 that Br and $(BH)_{max}$ are improved by the heat treatment of powders. However, $_iH_C$ is reduced. Accordingly, it is desired that the heat treating temperature is selected in a temperature range of 650°–950° C.

EXAMPLE 5

A rapidly-quenched ribbon with a width of about 10 mm and a thickness of about 100 μm was prepared from the ingot in Example 3, using a quenching copper disk. The ribbon was observed to have crystal grains of mainly 3 μm or less grain sizes with the C-plane orientation parallel with the main surface of the ribbon.

Then, the ribbon was heat-treated at 800° C. for one hour in argon atmosphere and thereafter was crushed and ground into a powder having an average particle size of 10 μm in the similar manner as in Example 4.

Then, the powder was further heat-treated at 550° C. for ten hours in argon atmosphere. Thereafter, polyehylene of 40 vol % and the powder of the balance were mixed with each other and injected into a mould at 100° C. in an aligning magnetic field of 20 kOe. Thus, a bonded magnet was produced.

Magnetic properties of the bonded magnet are shown in Table 2 together with those of a magnet produced from a non-heat-treated powder.

TABLE 2

| Heat-Treatment of Powder | Br (kG) | $_iH_C$ (kOe) | $(BH)_{max}$ (MGOe) |
|---|---|---|---|
| Carried | 7.0 | 10.0 | 10.5 |
| Not Carried | 6.4 | 11.5 | 8.5 |

Table 2 teaches us that Br and $(BH)_{max}$ are improved by the heat-treatment of the powder in addition to another heat-treatment of the ribbon with $_iH_C$ being slightly lowered in comparison with omission of the heat-treatment of the powder.

EXAMPLE 6

Using Nd of a purity factor of 97% and Dy added to the Nd by 5 at %, ferroboron, electrolytic iron, and electrolytic cobalt as starting materials, alloy ingots consisting of R 35.0 wt %, B 1.0 wt %, and the balance of $T=Fe_{1-x}Co_x$ (x=0, 0.1, 0.2, 0.3, 0.4, and 0.5, respectively) were prepared in the manner as described in Example 1.

Those ingots were melted and ejected onto the chill surface of a quenching copper disk rotating at a chill surface speed of 5 m/sec in the similar manner as in Example 1 to form rapidly-quenched alloy ribbons each having a width of about 10 mm and a thickness of about 200 μm. It was observed by the X-ray diffraction microanalysis that each of the resultant rapidly-quenched alloy ribbons contains fine $R_2T_{14}B$ crystal grains with a high rate of the C-plane orientation in a predominant direction.

Each of the alloy ribbons was crushed and ground into powders having an average particle size of 10 μm and then, heat-treated at 650° C. for one hour in the argon atmosphere.

Each powder and polyethylene of 40 vol % were mixed with each other and then, melted and injected into a mould at 100° C. in an aligning magnetic field of 20 kOe to form a bonded magnet.

Thus, bonded magnets of different cobalt contents were produced and magnetic properties were measured after being exposed in a magnetic field of 30 kOe.

Figure 4:
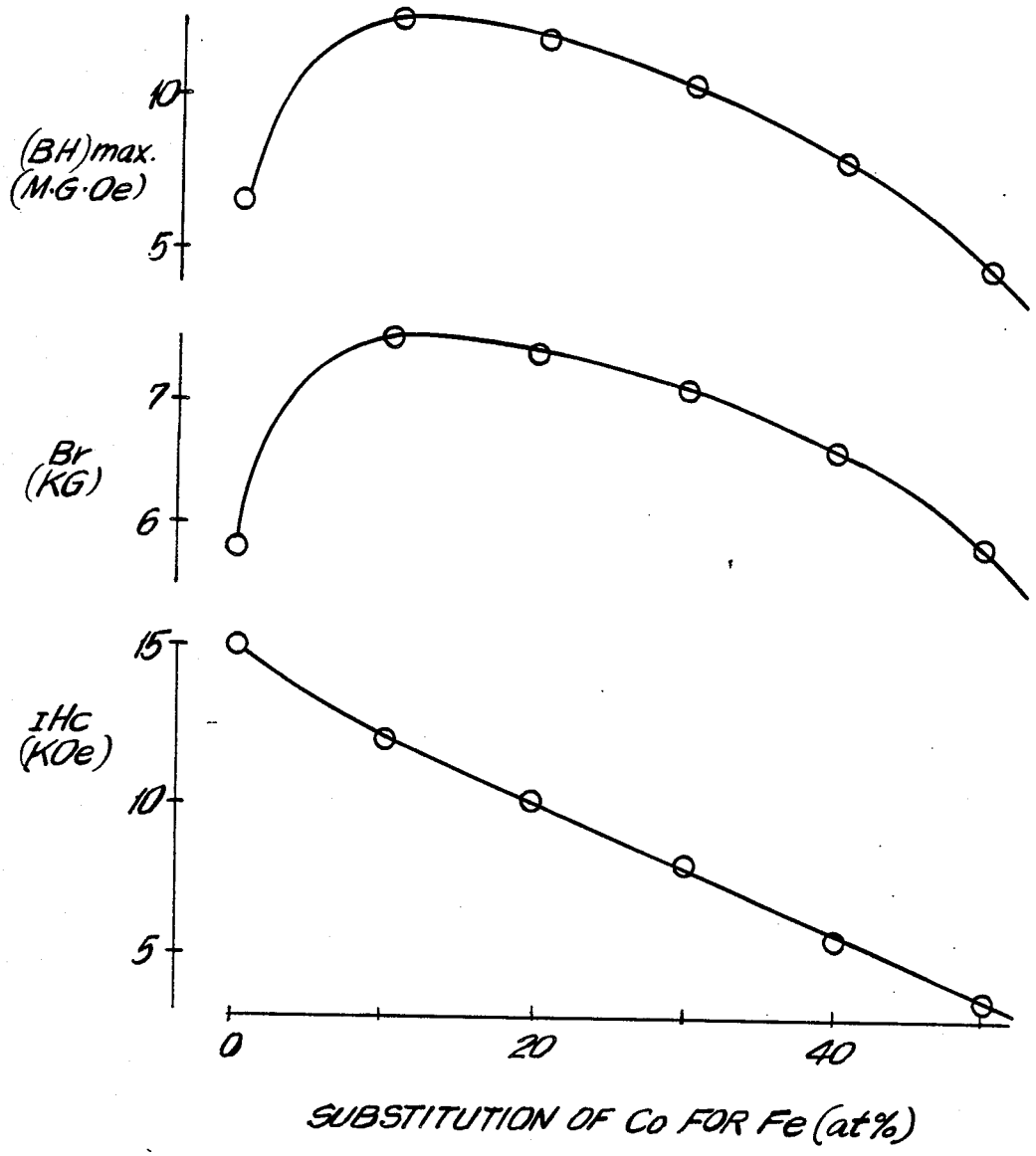
FIG. 4 is a graph showing magnetic properties of bonded magnets relative to Co contents substituted for Fe.

The measured magnetic properties are shown in FIG. 4. It will be understood from FIG. 4 that replacement of a part of Fe by Co up to 45 at % serves to improve Br and $(BH)_{max}$.

EXAMPLE 7

Using starting materials similar to that in Example 3, an alloy ingot consisting of R 33.0 wt %, B 1.0 wt %, and the balance of $T=Fe_{0.91}Co_{0.1}$ was prepared in the similar manner as in Example 3. Another ingot consisting of R 33.0 wt %, B 1.0 wt %, and the balance of Fe was also prepared.

From each of those ingots, a rapidly-quenched alloy ribbon having a width of about 10 mm and a thickness of about 100 μm was prepared by the continuous splat-quenching method using a quenching disk rotating at a chill surface speed of 8 m/sec.

The resultant ribbons were observed by the X-ray diffraction microanalysis. As a result, it was appreciated that one ribbon containing cobalt had a high rate of the C-plane orientation in a predominant direction in comparison with the other ribbon containing no cobalt.

These ribbons were crushed and ground into powders, respectively, each having an average particle size of 15 μm, and then, heat-treated at 650° C. for one hour in argon atmosphere.

Then, each powder was mixed with epoxy resin of amount of 25 vol % of a resultant mixture and compacted into a compact body by a pressing force of 5 ton.f/cm$^2$ in an aligning magnetic field of 30 kOe. The compacted body was heat-treated at 110° C. for one hour to form a bonded magnet.

Thus, bonded magnets were produced and subjected to measurement of magnetic properties after being magnetized by application of the magnetic field of 30 kOe. The measured magnetic properties are shown in Table 3.

TABLE 3

| Bonded Magnet | Br (kG) | $_IH_C$ (kOe) | $(BH)_{max}$ (MGOe) |
|---|---|---|---|
| R.Fe.B | 7.7 | 14.5 | 11.5 |
| R.($F_{90}$.$Co_{10}$).B | 8.2 | 11.0 | 14.5 |

Table 3 shows that replacement of a part of Fe by Co improves Br and $(BH)_{max}$ although slightly reducing $_IH_C$.

EXAMPLE 8

Using ferroboron, electrolytic iron, electrolytic cobalt, and Nd of a purity factor of 97% containing mainly Pr and Ce and Dy and Pr being added to the Nd by 10 at %, respectively, as starting materials, an alloy ingot consisting of R 34.0 wt %, B 1.0 wt %, and the balance of $T=Fe_{0.65}Co_{0.35}$ was prepared in the manner as described in Example 1.

From the ingot, two rapidly-quenched alloy ribbons having a width of 3 mm and a thickness of about 30 μm were prepared by the similar continuous splat-quenching method using a copper quenching disk rotating at the chill surface speed of about 15 m/sec.

One of the ribbons was exposed in a magnetic field during the rapidly-quenching condition.

Figure 5:
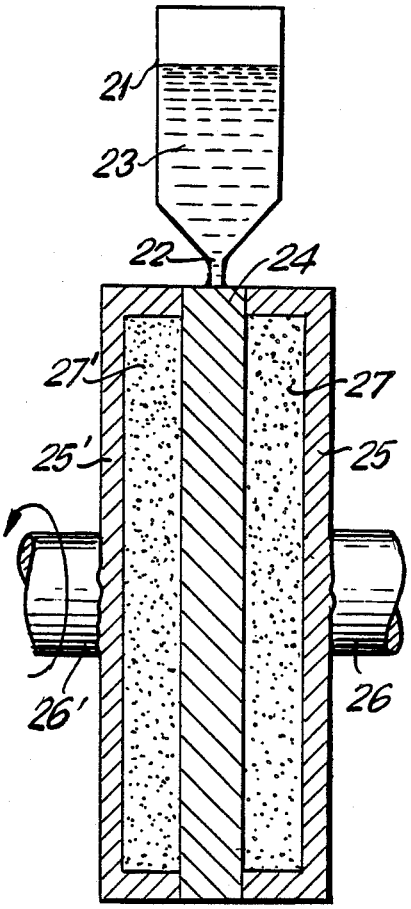
FIG. 5 is a sectional view of a device for preparing a rapidly-quenched alloy ribbon which is used in Example 8.

FIG. 5 shows a device used for preparing the ribbon with application of the magnetic field. The device comprises a melting tube 21 made of, for example, quartz, in which the alloy ingot is melted in a molten state. The melting tube 21 has a small orifice 22 through which the molten alloy 23 is ejected onto a quenching disk 24 of iron. On the opposite sides of the quenching disk 24, two hollow disk-shaped cases 25 and 25' are mounted which are made of non-magnetic steel and have rotating shafts 26 and 26' on a common central axis thereof. The cases 25 and 25' fixedly contain disk-shaped permanent magnets 27 and 27' which are magnetized in a thickness direction and have the same magnetic pole surfaces adjacent to the opposite surfaces of the quenching disk, respectively. Accordingly, the flux from the both magnets 27 and 27' radially flows at the outer peripheral surface of the iron quenching disk 24.

In this Example, for each magnets 27 and 27', a samarium cobalt magnet of a disk shape was used which had a diameter of 20 cm and a thickness of 2.5 cm with a surface flux density of 1 kGauss. An iron disk having a diameter of 21 cm and a thickness of 20 cm was used for the quenching disk 24. At the outer peripheral surface, a magnetic field was observed about 3 kOe.

Rotating the shafts 26 and 26' together so that the outer peripheral surface of the quenching disk 24 moves at a speed of about 15 m/sec, the molten alloy 23 was ejected through the orifice 22 onto the outer peripheral surface of the quenching disk 24 and the ribbon was produced. Accordingly, the ribbon was exposed in the radial magnetic field on the disk 24 so that the magnetic field was applied to the ribbon in the thickness direction during the ribbon being cooled.

While, the other ribbon was prepared by the device shown in FIG. 5 but the magnets 27 and 27' replaced by non-magnetic disks. Therefore, the other ribbon was not applied with any magnetic field.

Those ribbon were observed by the X-ray diffraction microanalysis to have fine crystal grains of about 1 μm or less. It was also observed that the ribbon applied with the magnetic field had many crystals of C-plane oriented in the parallel direction to the main surface of the ribbon in comparison with the other ribbon applied with no magnetic field.

Those ribbons were crushed and ground into powders having an average particle size of 10 μm, respectively, and then heat-treated at 550° C. for twenty hours in argon atmosphere.

Then, polyethylene of 40 vol % and each of the powders were mixed with each other and injected into a mould at about 100° C. in an aligning magnetic field of 20 kOe to form a bonded magnet.

Magnetic properties of each resultant bonded magnet are shown in Table 4.

TABLE 4

| Magnetic Field in Rapidly-Quenching Process | Br (kG) | $_IH_C$ (kOe) | $(BH)_{max}$ (MGOe) |
|---|---|---|---|
| Not Applied | 6.0 | 10.5 | 7.5 |
| Applied | 6.6 | 11.5 | 10.0 |

It will be understood from Table 4 that it considerably improves the magnetic properties of the bonded magnet to prepare the rapidly-quenched alloy ribbon in the magnetic field directed in a ribbon thickness.

EXAMPLE 9

Using the starting materials simlar in Example 3, an alloy ingot consisting of R 35.0 wt %, B 0.9 wt %, and the balance of Fe was made in the similar manner as in Example 1.

From the ingot, a rapidly-quenched alloy ribbon with a width of about 2 mm and a thickness of about 15 μm was prepared by the continuous splat-quenching method using an iron quenching disk in the similar manner as in Example 1.

Figures 6, 6A:
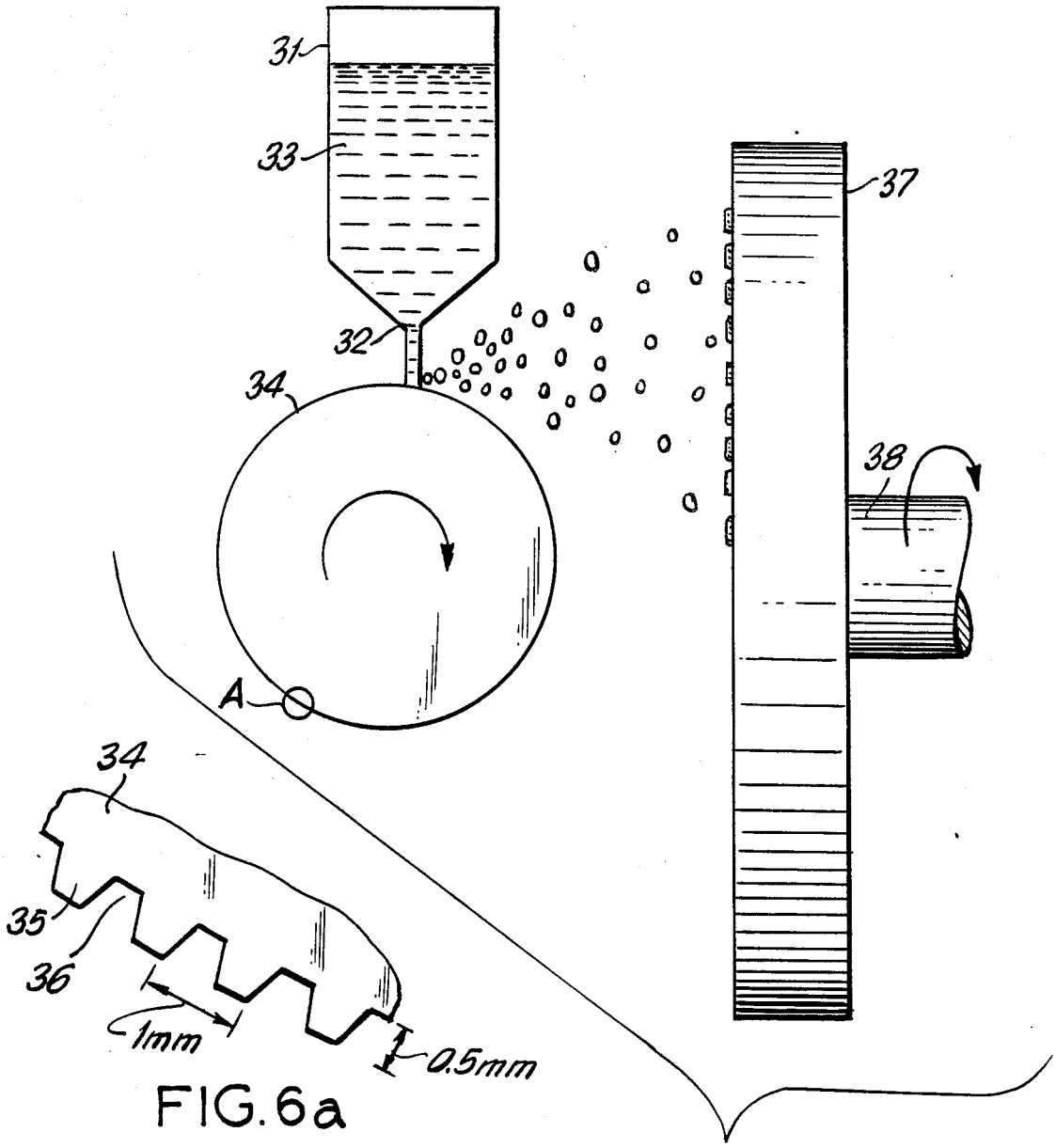
FIG. 6 is a side view of a device for preparing rapidly-quenched alloy flakes which is used in Example 9.
FIG. 6*a* is an enlarged view of a part in a circle A in FIG. 6.

On the other hand, rapidly quenched alloy flakes each having a diameter of about 1 mm and a thickness of about 15 μm were prepared using a device as shown in FIG. 6.

Referring to FIG. 6, a device is shown for preparing the rapidly-quenched alloy ribbons and/or flakes with the improved uniform orientation of crystals.

The device comprises a melting tube 31 of, for example, quartz having a small orifice 32 so that the molten alloy 33 is ejected through the orifice 32 onto a chill surface of the quenching disk 34 which is rotated at a predetermined speed.

The chill surface of the quenching disk 34 is formed with a plurality of projections 35 defining grooves 36 between adjacent two projections 35 as shown at an enlarged sectional view in FIG. 6*a*. In the present embodiment, projections 35 are formed at an repetition interval of 1 mm with a radial size of 0.5 mm.

A circular cooling plate 37 with a rotating shaft 38 is disposed at a side of the quenching disk 34 to have a main surface facing the chill surface of the quenching disk 34.

The alloy ingot was melted and ejected onto the chill surface of the quenching disk 34. The ejected molten alloy was sprayed by the plurality of projections 35 as atomized granules onto the main surface of the circular cooling plate 37. Each granule impinges onto the main surface and is deformed into a flat piece which is cooled to form a rapidly-quenched thin ribbon-like flake.

The ribbon and a lot of the flakes were crushed and ground into powders, respectively, each having an average particle size of 10 μm. The powders were heat-treated at 650° C. for one hour in argon atmosphere.

Then, each of the powders was mixed with polyethylene of amount of 40 vol % of a resultant mixture. The mixture was injected in a mould at 100° C. in an aligning magnetic field of 20 kOe to form a bonded magnet.

Thus, bonded magnets were produced and magnetic properties of the magnets are shown in Table 5.

TABLE 5

| Chill Disk Surface | Br (kG) | $_iH_C$ (kOe) | $(BH)_{max}$ (MGOe) |
|---|---|---|---|
| Flat | 5.6 | 12.5 | 6.0 |
| Grooves Formed | 6.0 | 12.5 | 8.0 |

Table 5 teaches us that magnetic properties, especially, Br and $(BH)_{max}$ are improved by use of the rapidly-quenched alloy flakes prepared by the device in FIG. 6 in comparison with alloy ribbon prepared by the usual continuous splat-quenching method.

EXAMPLE 10

An alloy ingot consisting of R 32.0 wt %, B 1.0 wt %, and the balance of Fe was prepared using the similar starting materials and a similar melting method as in Example 1.

Figure 7:
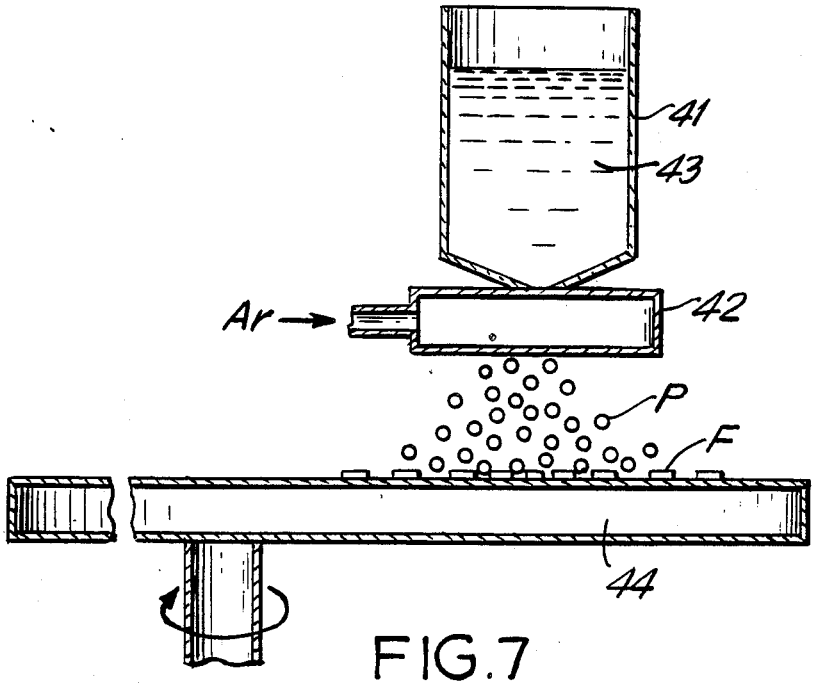
FIG. 7 is a sectional view of a device for preparing rapidly-quenched alloy flakes which is used in Example 10.

From the ingot, a lot of granules or small balls having a particle size of about 0.2 mm were prepared by the known atomizing method and a lot of flakes having a diameter of about 0.3 mm and a thickness of about 100 μm were prepared by use of a device shown in FIG. 7.

Referring to FIG. 7, the device shown therein comprises a melting tube 41 of quartz and a spray nozzle 42 mounted at a lower portion of the melting tube 41. An alloy is melted in the melting tube 41 in a molten state. The molten alloy 43 is sprayed through the spray nozzle 42 in an atomized particles P by application of compressed argon gas Ar into the spraying nozzle 42. This method is well known in the prior art as the atomizing method for preparing an amorphous alloy wherein the atomized particles are cooled in circular small balls or granules. In the device as shown in the figure, a cooling plate 44 of such as copper is disposed under the nozzle 42 and is rotated. The atomized particles P before being cooled and cured impinge onto the main surface of the cooling plate 44 and deformed and cooled into small flat flakes F.

The granular alloy and the flaky alloy were subjected to the X-ray diffraction microanalysis. As a result, it was appreciated that the former had $R_2Fe_{14}B$ crystal grains with C-planes oriented in various directions. While the latter also had $R_2Fe_{14}B$ crystal grains but C-planes predominantly directed in a parallel direction with the cooling surface of the cooling plate, although a free surface layer of the flaky alloy contained a small part of crystal grains oriented in a direction perpendicular to the cooling surface.

A lot of the granular alloy balls and a lot of the flakes were crushed and ground into powders, respectively, each having an average particle size of 15 μm, and then, were heat-treated at 650° C. for one hour in argon atmosphere.

Each of the powders was mixed with epoxyethylene of 25 vol % of a resultant mixture and compacted into a compact body by a pressing force of 5 ton.f/cm$^2$ in an aligning magnetic field of 30 kOe. Thereafter, the compact body was heat-treated at 110° C. for one hour to form a bonded magnet.

Thus, bonded magnets were produced and subjected to measurement of magnetic properties. The measured properties are shown in Table 6.

TABLE 6

| Rapidly-Quenched Alloy | Br (kG) | $_iH_C$ (kOe) | $(BH)_{max}$ (MGOe) |
|---|---|---|---|
| Granular Powder | 5.8 | 8.5 | 5.5 |
| Disk-like Flakes | 8.7 | 11.0 | 14.0 |

It will be understood from Table 6 that use of rapidly-quenched flakes prepared by the device of FIG. 7 considerably improves the magnetic properties in comparison with the rapidly-quenched granules prepared by the conventional atomizing method.

EXAMPLE 11

Using an ingot prepared in the similar manner as in Example 3, rapidly-quenched alloy granules having an average particle size of about 30 μm were prepared by the conventional atomizing method, and rapidly-quenched alloy flakes having an average diameter of about 0.1 mm and an average thickness of about 50 μm were also prepared by use of the device in FIG. 7 in the similar manner as in Example 10.

It was observed by the X-ray diffraction microanalysis that the flaky alloy had $R_2T_{14}B$ crystal grains with C-planes predominantly oriented in a parallel direction with the cooling surface while the granular alloy also having $R_2T_{14}B$ crystal grains but C-planes oriented in different directions.

A lot of the granules and a lot of the flakes were crushed and ground into powders, respectively, each having an average particle size of 10 μm, and then, were heat-treated at the similar heat-treating condition in Example 10.

Each of the powders was mixed with polyethylene of 40 vol % of a resultant mixture and injected into a mould at 100° C. in an aligning magnetic field of 20 kOe to form a bonded magnet.

Magnetic properties of resultant bonded magnets are shown in Table 7. It is also noted from Table 7 that use of the rapidly-quenched alloy flakes considerably improves the magnetic properties in comparison with the rapidly-quenched alloy granules.

TABLE 7

| Rapidly-Quenched Alloy | Br (kG) | $_iH_C$ (kOe) | $(BH)_{max}$ (MGOe) |
|---|---|---|---|
| Granular Powder | 5.4 | 10.0 | 4.0 |
| Disk-like | 7.1 | 13.5 | 9.5 |

TABLE 7-continued

| Rapidly-Quenched Alloy | Br (kG) | $_iH_C$ (kOe) | $(BH)_{max}$ (MGOe) |
|---|---|---|---|
| Flakes | | | |

EXAMPLE 12

Figure 8:
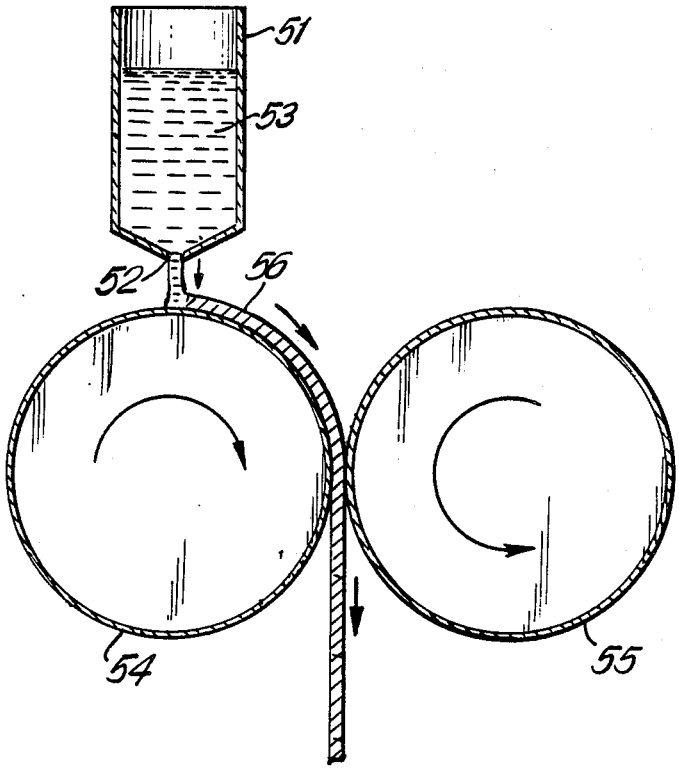
FIG. 8 is a sectional view of a device for preparing a rapidly-quenched alloy ribbon which is used in Example 12.

The ingot consisting of R 32.0 wt %, B 1.0 wt %, and the balance of Fe was prepared by use of the similar starting materials and in the similar manner as described in Example 1, and rapidly-quenched alloy ribbons having different thickness were prepared by use of a rapidly-quenched alloy producing device shown in FIG. 8.

Referring to FIG. 8, the device shown therein comprises a melting tube 51 of, for example, quartz having a small orifice 52 on its bottom portion. An alloy is melted in the melting tube 51 in the molten state shown at 53. Under the orifice 52, a quenching disk 54 is disposed so that the molten alloy 53 is ejected onto an outer peripheral chill surface of the quenching disk 54 through the orifice 52. Another cooling disk 55 is disposed adjacent to the quenching disk 55 is disposed adjacent to the quenching disk 54 so that it has an outer peripheral surface spaced by a small gap from the chill surface. Both of the disk 54 and 55 rotate in opposite direction to each other but with a rotating speed.

The molten alloy ejected from the orifice 52 onto the chill surface of the disk 54 is formed into a ribbon form and thereafter a free surface of the ribbon 56 comes into contact with the outer surface of disk 55. Accordingly, the free surface of the ribbon 56 is also rapidly quenched by the disk 55 but delayed from the opposite surfacer impinging the disk 54.

In the prior art, a method using two quenching disks is well known for forming amorphous alloy ribbon (which will be referred to as "a double chill disk method" hereinafter) wherein, referring to FIG. 8, the molten alloy 53 is directly ejected into a small gap between two disks 54 and 55 so that the molten alloy is rapidly quenched from the both sides at the same time. In this connection, the continuous splat-quenching method using a single quenching disk as disclosed in References 2, 3, and 5 will be referred to as a "single chill disk method."

The device shown in FIG. 8 uses two disks similar to the double disk method but the molten alloy comes into contact with the two disks at not the same time but different times. Therefore, the method using the device shown in FIG. 8 will be referred to as a "modified double chill disk."

Variation of chill surface moving speed of disks 54 and 55 from about 1 m/sec to about 50 m/sec made the thickness of the ribbon vary from 10 μm to 2000 μm with variation of width from 0.5 to 20 mm.

As comparative samples, rapidly quenched alloy ribbons having different thicknesses varying within the similar extent were prepared by the single chill disk method and by the double chill disk method, respectively.

Those ribbons were observed by the X-ray diffraction microanalysis and it was appreciated that they had $Nd_2Fe_{14}B$ crystal grains. Further, ribbons having an increased thickness had the increased number of crystals of which C-planes were predominantly aligned or oriented in a certain direction. The C-plane orientation was changed from a parallel direction to a perpendicular direction to the main surface of the ribbon as the ribbon thickness increased.

Then, those ribbons were crushed and ground to form powders, respectively, each having an average particle size of 15 μm. Each of the powders was heat-treated at 650° C. for one hour in argon atmosphere, and then, mixed with epoxy resin of 25 vol % of a resultant mixture. The mixture was compacted into a compact body by a pressing force of 5 ton.f/cm$^2$ in an aligning magnetic field of 30 kOe. The compact body was heat-treated at 110° C. for one hour to form a bonded magnet. Magnetic properties of the bonded magnet were measured after application of a magnetic field of 30 kOe.

Figure 9:
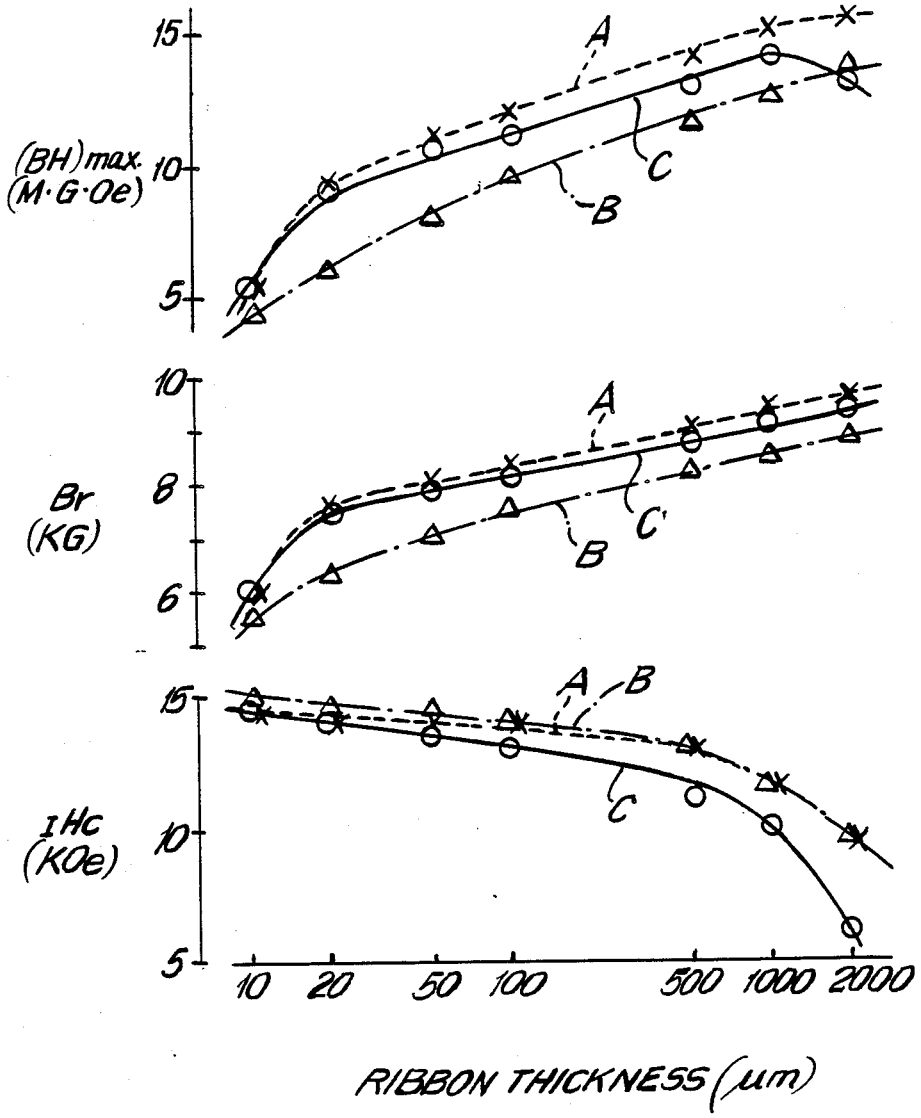
FIG. 9 is a graph showing magnetic properties of bonded magnets in Example 12 relative to thickness of alloy ribbons which are prepared by different rapidly-quenching methods.

Thus, magnetic properties of the resultant bonded magnets are shown in FIG. 9.

In FIG. 9, broken lines A represent magnetic properties of magnets using ribbons prepared by the modified double chill disk method, alternate long and short dash lines B are for use of ribbons prepared by the double chill disk method, and solid lines C are for ribbons prepared by the single chill disk method.

It will be noted from FIG. 9 that use of the ribbons produced by the modified double chill disk method provides magnetic properties higher than any other ribbons prepared by the single chill disk method and the double chill disk method.

EXAMPLE 13

Rapidly-quenched alloy ribbons having a thickness of about 500 μm and a width of about 15 mm were prepared from the ingot prepared in Example 3 by the single chill disk method, the double chill disk method, and the modified chill disk method, respectively. It was appreciated by the X-ray diffraction microanalysis that these ribbons also had micro structure similar to the ribbons as in Example 12.

These ribbons were crushed and ground into powders, respectively, each having an average particle size of 10 μm. Each of the powders was heat-treated at 650° C. for one hour in argon atmosphere. Then, polyethylene of 40 vol % and the powder were mixed with each other and injected into a mould at 100° C. in an aligning magnetic field of 20 kOe to form a bonded magnet.

Magnetic properties of resultant bonded magnet are shown in Table 8. Table 8 teaches us that bonded magnet made from the ribbon prepared by the modified double chill disk method has magnetic properties higher than any other magnets made from ribbons prepared by the single chill disk method and the double chill disk method.

TABLE 8

| Rapidly-Quenching Method | Br (kG) | $_iH_C$ (kOe) | $(BH)_{max}$ (MGOe) |
|---|---|---|---|
| Single Disk Method | 7.4 | 9.0 | 11.5 |
| Double Disk Method | 6.9 | 13.0 | 9.5 |
| Modified Double Disk Method | 7.7 | 13.0 | 13.0 |

What is claimed is:

1. A method for producing a rare earth metal-transition metal-boron (R-T-B) anisotropic bonded magnet wherein a magnetic powder of R-T-B alloy substantially consisting of $R_2T_{14}B$ is dispersed in and bonded by binder agent, the method comprising steps of:

preparing said R-T-B alloy in a molten state;

rapidly quenching said molten alloy to form an R-T-B alloy ribbon and/or ribbonlike flakes, each having a thickness of 20–1,000 μm and having $R_2T_{14}B$ crystal grains; the crystal grains having an average particle size less than the thickness of said ribbon and/or flakes and varying in orientation in the direction of said thickness;

crushing and grinding said ribbon and/or flakes into a magnetic powder having an average particle size which is less than the thickness of said ribbon and/or flakes before grinding;

mixing said magnetic powder with a binder agent to form a mixture;

and then forming said mixture into a desired bulk-shape body while disposed within an aligning magnetic flux to produce a bonded magnet characterized by magnetic anisotropy.

2. A method as claimed in claim 1, wherein said $R_2T_{14}B$ crystal grains of said alloy ribbon and/or flakes have an average grain size of 0.01–20 μm.

3. A method as claimed in claim 1, wherein said transition metal T is Fe.

4. A method as claimed in claim 1, wherein said transition metal T consists by, atomic ratio, of Co 45 at % or less and the balance of Fe.

5. A method as claimed in claim 1, wherein said rare earth metal R is Nd.

6. A method as claimed in claim 1, wherein said rare earth metal R consists of cerium didymium and Dy.

7. A method as claimed in claim 6, wherein said cerium didymium consisting of Ce 5 wt %, Pr 15 wt %, and the substantially balance of Nd.

8. A method as claimed in claim 6, wherein the amount of Dy is 5 at %.

9. A method as claimed in claim 1, further comprising a step of heat-treating said magnetic powder at a temperature of 500°–700° C. prior to said mixing step.

10. A method as claimed in claim 1, further comprising a step of heat-treating said alloy ribbon and/or flakes at a temperature of 650°–950° C. prior to said crushing and grinding step.

11. A method as claimed in claim 10, further comprising step of heat-treating said magnetic powder at a temperature of 500°–700° C. prior to said mixing step.

12. A method as claimed in claim 1, wherein said forming step comprises a process for pressing said mixture into said desired bulk-shape body in said aligning magnetic field by a pressing force.

13. A method as claimed in claim 12, wherein said binder agent is a thermosetting resin having a curing temperature, said bulk-shape body being heated at said curing temperature to produce said bonded magnet.

14. A method as claimed in claim 13, wherein said binder agent is epoxy resin.

15. A method as claimed in claim 1, wherein said binder agent is a thermoplastic resin having a resin melting temperature.

16. A method as claimed in claim 15, wherein said binder agent is polyethylene.

17. A method as claimed in claim 15, wherein said forming step comprises a process for heating and injecting said mixture into a mould at said resin melting temperature in said aligning magnetic field to produce said bonded magnet.

18. A method as claimed in claim 1, wherein said molten alloy is rapidly quenched by ejecting it through a small orifice onto an outer peripheral chill surface of a rotating quenching disk, said ejected molten alloy thereby forming a rapidly-quenched ribbon and/or ribbon-like flakes.

19. A method as claimed in claim 18 wherein a magnetic field is applied in a radial direction of said quenching disk so that said ejected molten alloy is cooled in said magnetic field.

20. A method as claimed in claim 18, wherein said quenching disk is provided with a plurality of projections formed in said chilling surface and a cooling plate is disposed adjacent said quenching disk, said molten alloy ejected onto the chilling surface is sprayed onto said cooling plate to form flat ribbon-like flakes.

21. A method as claimed in claim 20, wherein each of said flat ribbon-like flakes has a thickness of 7–500 μm.

22. A method as claimed in claim 18, wherein after said molten alloy is deposited onto said chilling surface and is rapidly quenched to form a ribbon, an outer surface of said ribbon is rapidly quenched by engagement with another quenching disk to obtain a rapidly-quenched ribbon.

23. A method as claimed in claim 1, wherein said molten alloy is sprayed and atomized through a spray nozzle onto a cooling plate and rapidly cooled on said cooling plate to form flat ribbon-like flakes.

* * * * *